United States Patent [19]

Hayashi et al.

[11] 4,285,385

[45] Aug. 25, 1981

[54] METHOD FOR THE PRODUCTION OF HEAT EXCHANGERS

[75] Inventors: Masakatsu Hayashi, Ushikumachi; Takeo Tanaka, Minorimachi; Tatsuo Natori, Kashiwa; Tatsushi Aizawa, Shimoinayoshi; Shigeru Kojima, Kasukabe; Takao Senshu, Shimizu, all of Japan

[73] Assignee: Hitachi, Ltd., Tokyo, Japan

[21] Appl. No.: 51,141

[22] Filed: Jun. 22, 1979

[30] Foreign Application Priority Data

Jun. 28, 1978 [JP] Japan ..... 53/77417

[51] Int. Cl.[3] ..... B22C 9/04; B22D 19/00

[52] U.S. Cl. ..... 164/9; 164/34; 164/98; 164/112; 164/119

[58] Field of Search ..... 164/9, 34, 98, 112, 164/119, 132

[56] References Cited

U.S. PATENT DOCUMENTS

| | | | |
|---|---|---|---|
| 3,756,303 | 9/1973 | Valdo | 164/98 X |
| 3,848,666 | 11/1974 | Valdo | 164/98 X |
| 3,946,039 | 3/1976 | Walz | 164/34 X |

FOREIGN PATENT DOCUMENTS

| | | |
|---|---|---|
| 50-154853 | 12/1975 | Japan . |
| 51-23848 | 2/1976 | Japan . |

*Primary Examiner*—R. L. Spruill
*Assistant Examiner*—J. Reed Batten, Jr.
*Attorney, Agent, or Firm*—Craig and Antonelli

[57] ABSTRACT

A method of producing a heat exchanger in which a fin block of porous metal and fin plates connected to the fin block are unitarily secured to a serpentine heat-transmitting pipe. A plurality of fin molds produced with the use of plastic patterns formed therein with continuous, three-dimensional cavities are assembled with the heat-transmitting pipe shaped beforehand into a serpentine form in such a manner that the fin molds enclose the heat-transmitting pipe with suitable spacing intervals defined between the fin molds themselves and between the fin molds and the heat-transmitting pipe. Molten metal of high thermal conductivity is cast into continuous cavities in the fin molds and into the spacing intervals, and the material of the fin molds is removed after the molten metal has solidified.

2 Claims, 24 Drawing Figures

METHOD FOR THE PRODUCTION OF HEAT EXCHANGERS

BACKGROUND OF THE INVENTION

1. Field of the Invention

The present invention relates to a method for the production of heat exchangers of the type including a fin block made of porous metal having a multiplicity of continuous pores through which one of the fluids to be heat-exchanged flows. The heat exchangers produced by the method of the invention are used for causing heat-exchange between two fluids of different temperatures, and have many applications. For example, the heat exchangers may be used as heat exchangers for fan-coil unit and as evaporators and condensers for refrigerating devices and air conditioning systems in which air is used as one of the fluids to be heat-exchanged.

2. Description of the Prior Art

The prior art having relevance to the present invention includes a heat exchanger disclosed in Laid-Open Japanese Patent Application, Laid-Open No. 154853/75 which comprises a fin block formed of foamed metal body produced by adding a foam-producing agent into molten metal to thereby cause foaming of the molten metal. Also known in the art is a heat exchanger disclosed in Laid-Open Japanese Patent Application, Laid-Open No. 23848/76 which uses a metal fin block produced by bonding together metal particles for example by sintering process. However, the former Japanese Application has the disadvantage that flow resistance imposed on the fluid passing through passages formed by the pores is increased, since very thin interconnecting portions between the continuous pores are constricted and independent and since discontinuous pores tend to be produced in the metal fin block. Further, it is difficult to obtain the foamed metal fin block having uniform density over the entire area.

In the latter Japanese Application, gaps between the metal particles provide passages for fluid. With this structure, it is difficult to obtain high percentage of gap area in the produced metal fin block. Further, this prior art heat exchanger suffers from high production time as well as high price.

Because of the problems encountered with the prior art heat exchangers described above, they have not been practically used in the field.

Nowadays, it is a common practice to use heat exchangers including plate-like fins. The majority of the heat exchangers now commonly used are heat exchangers of the cross-fin type in which a large number of plate-like fins are secured to the heat-transmitting piping perpendicularly to its longitudinal axis in closely adjacent relation, to maximize the heat-transfer area.

Regardless of whether the heat-transmitting piping consists of a serpentine pipe or a plurality of parallel pipes interconnected by means of a header, the pipes must be connected together after the fins are secured thereto in a multiplicity of rows. Fabrication of a heat exchanger thus involves many process steps to be performed including assembling of the parts which is troublesome; and productivity is low because these process steps take a long time to perform. In heat exchangers of the cross-fin type, fluid flows through the gaps between the plate fins. Thus, it is impossible to increase the heat-transfer area by narrowing the gaps and increasing the number of fins, because such attempt will entail an increase in the resistance imposed on the flow of fluid and restrictions will be placed on the working of the pipes and fins.

SUMMARY OF THE INVENTION

This invention has as its object the provision of a novel method for the production of heat exchangers which obviates the aforementioned disadvantages of the prior art by utilizing new production techniques to produce heat exchangers of high heat-transfer performance, light weight and compact size.

According to one of the features of the present invention, fin molds formed of metal body having continuous, three-dimensional cavities of the mesh-like shape are prepared by using expandable patterns, a plurality of such fin molds are assembled with a heat transmitting pipe prepared beforehand in a serpentine or other suitable form in such a manner that suitable spacing intervals are defined between the fin molds themselves and between the fin molds and the heat-transmitting pipe, and then a charge of molten metal is cast into the cavities in the fin molds as well as into the spacing intervals. After the material of the fin molds is removed, there is obtained a heat exchanger comprising a heat-transmitting pipe; a fin block, corresponding to plate fins of the prior art; and enclosing the heat-transmitting pipe, a plurality of fin plates located in positions in the fin block. The fin block and the fin plates are bonded to the heat-transmitting pipe unitarily therewith when the charge of molten metal is cast into the fin molds.

DESCRIPTION OF THE PREFERRED EMBODIMENTS

FIGS. 1 to 6 show heat exchangers produced by the method according to the present invention. As shown, each heat exchanger comprises a heat-transmitting pipe 1 prepared beforehand in the form of a serpentine pipe, a fin block 2 of large thickness enclosing the heat-transmitting pipe 1 in such a manner that the ends of the pipe 1 are left uncovered and exposed to the outside, and a plurality of fin plates 3 each located in a suitable position in the fin block 2 and secured to the heat-transmitting pipe 1. The fin block 2 and the fin plates 3 are secured to the heat-transmitting pipe unitarily therewith by casting. In the heat exchanger shown in FIG. 1, straight portions of the pipe 1 are embedded in the fin block 2 while bends of the pipe 1 are left uncovered and exposed to the outside like the ends of the pipe 1. In the heat exchangers shown in FIGS. 2 to 6, the straight portions as well as the bends of the pipe 1 are embedded in the fin block 2.

Figure 7:
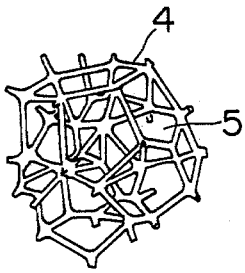
FIGS. 7 and 8 are views, on an enlarged scale, of the fin blocks forming a part of the heat exchangers shown in FIGS. 1 to 6.
Figure 8:
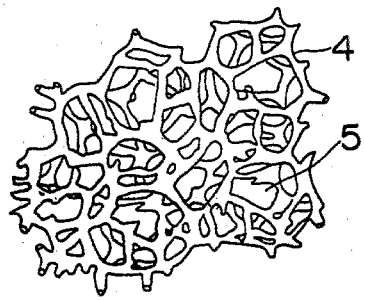

The fin block 2 is formed of porous metal having fins 4 of filament line form arranged in a skeleton structure to form a multiplicity of pores 5 in the fin block 2. The fins 4 may be in a simple filament line form as shown, on an enlarged scale, in FIG. 7 or in an irregular filament line form having projections and depressions as shown, on an enlarged scale, in FIG. 8. Air flows through the pores 5, and heat exchange takes place between the air and a fluid, such as water and refrigerant, flowing through the heat-transmitting pipe 1; via the fins 4 in the fin block 2 and the fin plates 3 secured to the heat-transmitting pipe 1.

The method according to the invention for producing the heat exchangers shown in FIGS. 1 to 6 will now be described.

Figure 1:
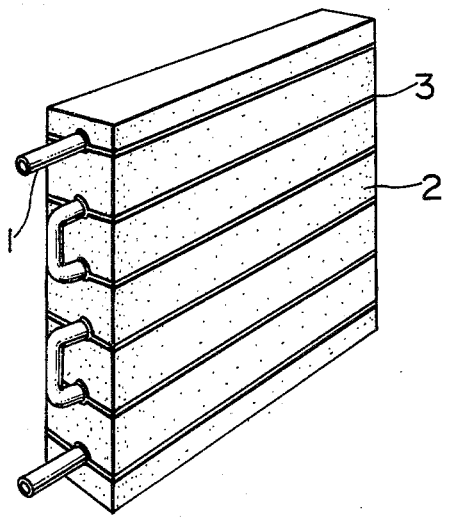
FIG. 1 is a perspective view of one form of a heat exchanger produced by the method according to the present invention.

The heat exchanger shown in FIG. 1 is of the type in which only the straight portions of the heat-transmitting pipe 1 prepared in the form of a serpentine pipe is enclosed by the fin block 2, and the bends and the ends of the pipe 1 are left uncovered by the fin block 2 and exposed to the outside.

Figure 9A:
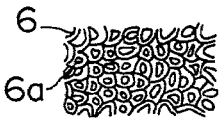
FIGS. 9A, 9B, 9C and 9D exemplarily illustrate the method for producing heat exchangers according to the invention.
Figure 9B:
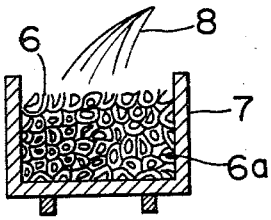

In producing the heat exchanger shown in FIG. 1, a pattern 6 for the fin block 2, in FIG. 9A, is formed of a porous plastic of high air-permeability, such as foamed polyurethane, which has continuous cavities. The pattern 6 is formed with a groove on one side thereof or on both sides thereof for permitting the straight portion of the heat-transmitting pipe 1 to be fitted therein. The pattern 6 is then fitted into a frame 7 as shown in FIG. 9B, and a mold forming material 8 in a fluid state is filled in cavities 6*a* in the pattern 6, thereby to provide a pattern-retaining mold. As a mold forming material, a slurry containing plaster powder and water; a slurry containing plaster powder added with common salt and water; a slurry containing $SiO_2$ powder of less than 270 mesh and a binder composed of ethyl silicate, industrial ethyl alcohol and water; or other ordinary mold forming material may be used. The pattern-retaining mold prepared as aforesaid wherein the pattern 6 of plastic is filled with the mold forming material 8 is subjected to firing or the like to burn out or remove the plastic pattern 6, thereby to form the continuous dendrite fins 4 of the skeleton structure having the pores 5 therein.

In this way, a fin mold 9 (FIG. 11) formed on both sides thereof with a groove 11 for fittingly receiving straight portion of the heat-transmitting pipe 1 and a fin mold 10 (FIG. 12) formed only on one side thereof with a groove 11 for fittingly receiving a straight portion of the pipe 1 are produced. The fin molds 9 and 10 are preferably given with their respective shapes when the plastic patterns 6 are prepared. However, the fin molds 9 and 10 may be given with their shapes after the plastic patterns 6 are filled with the mold forming material and the pattern-retaining molds are produced. The grooves 11 are formed such that their diameter is slightly larger than the diameter of the heat-transmitting pipe 1.

Figure 9D:
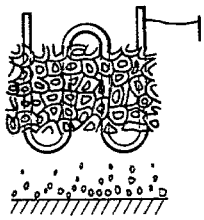
Figure 9C:
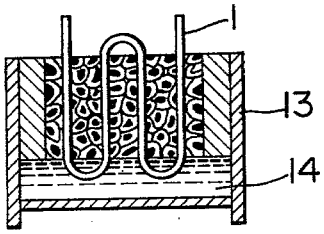
Figure 13:
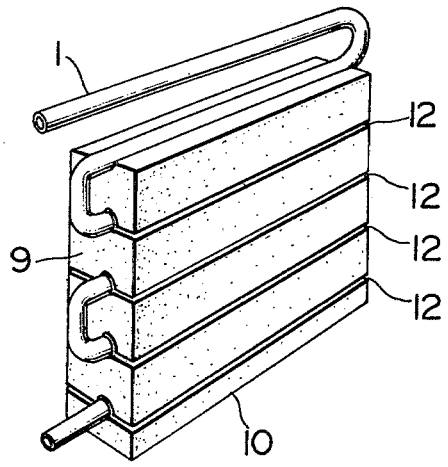
FIG. 13 is a perspective view showing the fin molds of FIGS. 11 and 12, assembled with a heat-transmitting serpentine pipe for producing the heat exchanger shown in FIG. 1.
Figure 14:
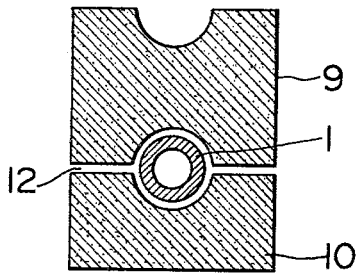
FIG. 14 is a cross-sectional view illustrating the positional relation between the heat-transmitting pipe and the fin molds shown in FIG. 13.

A plurality of the fin molds 9 and 10 are assembled with the heat-transmitting pipe 1 of the serpentine form to be disposed longitudinally along the length of the pipe 1 as shown in FIG. 13. In assembling the fin molds 9 and 10 with the heat-transmitting serpentine pipe 1, spacing intervals 12 are defined between the fin molds 9 and 10 themselves and between the fin molds 9 and 10 and the pipe 1 as shown in FIG. 14. Following the assembling of the fin molds 9 and 10 with the heat-transmitting pipe 1 as shown in FIG. 13 to produce a fin block mold, the fin block mold is placed in a metal frame 13 as shown in FIG. 9*c*, and molten metal 14 is cast or filled into cavities in the fin block mold after the pressure in the cavities is either increased or reduced. A metal of good thermal conductivity, such as aluminium, copper, iron, etc., may be used as material for the molten metal. Also, any iron-base alloy or non-ferrous metal, such as lead, tin, zinc, magnesium, etc., may be used.

Figure 10:
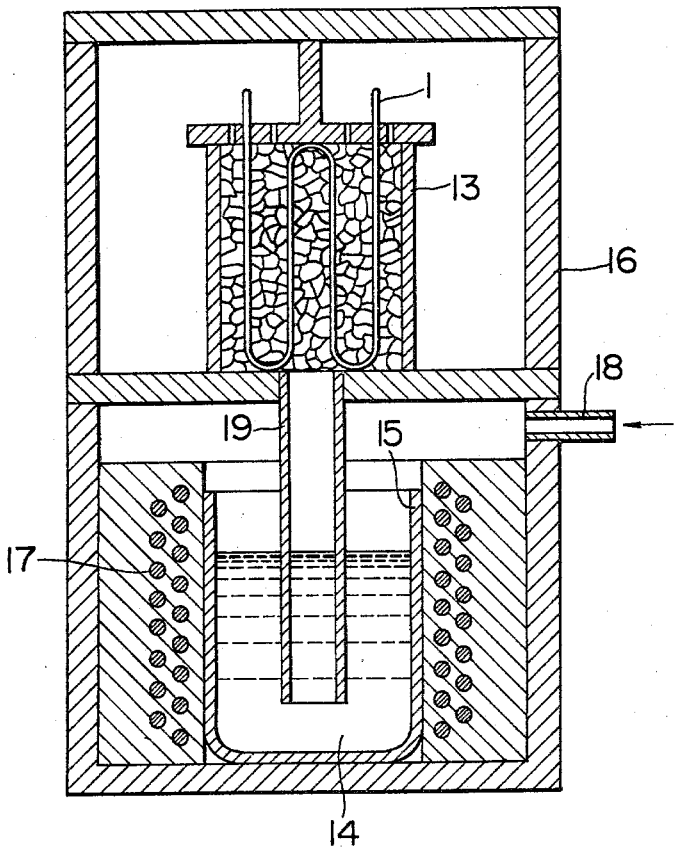
FIG. 10 is a sectional view showing exemplarily the manner in which charge of molten metal is introduced into the fin molds in the method according to the invention.

A charge of molten metal may be cast or filled into the cavities in the fin block mold as shown in FIG. 10, for example. As shown, the metal frame 13 having the fin block mold fitted therein is set in a pressure vessel 16 having a crucible 15 disposed in its lower portion. The crucible 15 is filled therein with the molten metal 14 produced by heating and melting the metal by an electric heater or other heating source 17. The molten metal 14 is pressurized by compressed air or the like introduced into the pressure vessel 16 through a feed passage 18, and cast into the cavities in the fin block mold and into the spacing intervals 12, through a passage 19. After the molten metal cast into the cavities and the spacing intervals has solidified, the fin block mold is taken out from the metal frame 13, and the mold material is removed by immersing the fin block mold in water as shown in FIG. 9D, vibrating the fin block mold, heating the fin block mold at high temperature, or the like process. In this way, a heat exchanger is obtained which comprises the heat-transmitting serpentine pipe 1, the fin block 2 of porous metal composed of the fins 4 of filament line form arranged in a skeleton structure to form the multiplicity of continuous, three-dimensional pores 5 shown in FIG. 7 or 8, and the fin plates 3 located in the fin block 2 in positions corresponding to the straight portions of the serpentine pipe 1 to secure the fin block 2 to the serpentine pipe 1. The fin block 2 enclosed substantially all the heat-transmitting pipe 1 except the ends and bends thereof which are left uncovered and exposed to the outside.

Figure 11:
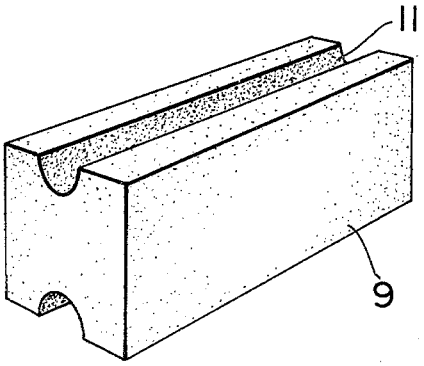
FIGS. 11 and 12 are perspective views showing fin molds used in the production of the heat exchanger shown in FIG. 1.
Figure 12:
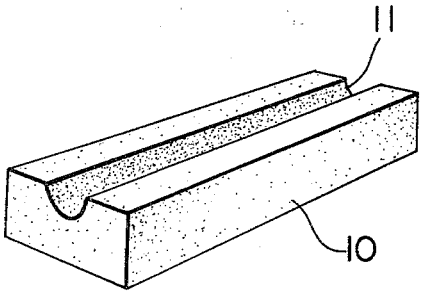

In the foregoing description, the fin molds produced beforehand are described as being assembled with the heat-transmitting pipe with suitable spacing intervals between the molds themselves and between the molds and the heat-transmitting serpentine pipe. However, the present invention is not limited to this process, and pattern-retaining molds may be shaped in the form as shown in FIGS. 11 and 12, in turn assembled as shown in FIG. 13, and in turn subjected to heating or the like to remove the plastic patterns without leaving a residue, to thereby obtain a fin block mold having continuous cavities.

Figure 2:
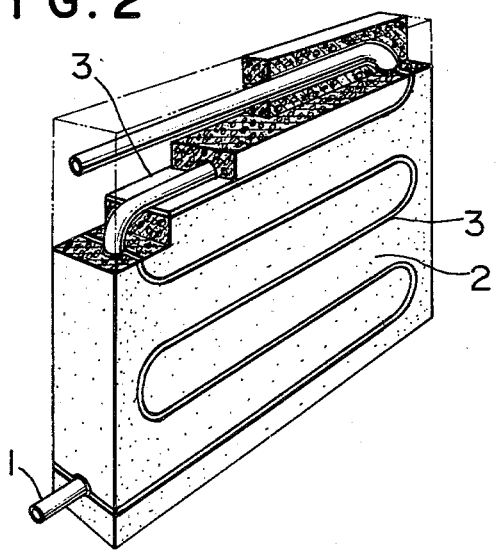
FIGS. 2 to 6 are perspective views, with certain parts being cut-away, of other forms of heat exchangers produced by the method according to the invention.
Figure 15:
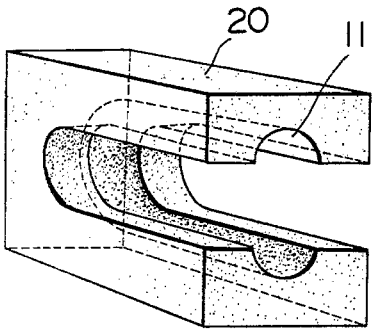
FIGS. 15 and 16 are perspective views showing outer and inner fin molds, respectively, used for producing the heat exchangers shown in FIGS. 2 to 6.
Figure 16:
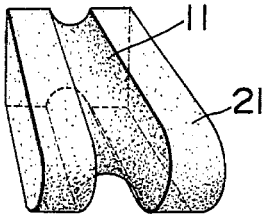
Figure 17:
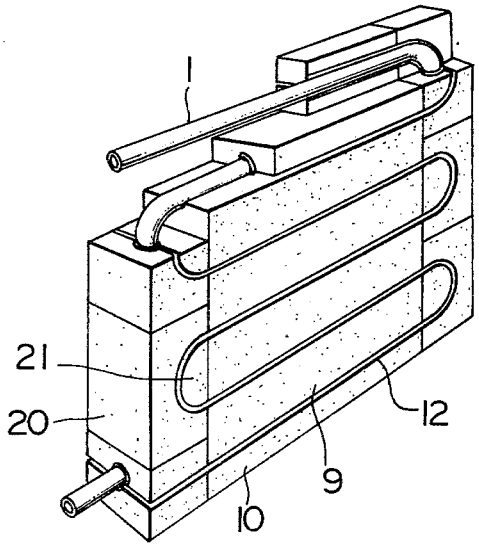
FIGS. 17 to 21 are perspective views showing the fin molds of FIGS. 15 and 16 as assembled with a heat-transmitting serpentine pipe for producing the heat exchangers shown in FIGS. 2 to 6.

The heat exchangers shown in FIGS. 2 to 6 have both the straight portions and the bends of the heat-transmitting pipe 1 embedded in the fin block 2 after the pipe 1 is shaped into a serpentine form. In producing these types of heat exchangers, an outer fin mold 20 and an inner fin mold 21 shown in FIGS. 15 and 16, respectively, are used as mold members to be disposed around the bends of the heat-transmitting serpentine pipe 1, and the fin molds 9 and 10 are used as mold members to be disposed around the straight portions of the pipe 1. Plastic patterns and mold forming material are used to produce the fin molds 9 and 10 shown in FIGS. 11 and 12, and the outer fin mold 20 and inner fin mold 21 shown in FIGS. 15 and 16, respectively, in the same manner as described with reference to the heat exchanger shown in FIG. 1. When the heat exchanger to be produced is as shown in FIG. 2, the fin molds 9 and 10, the outer fin mold 20 and inner fin mold 21 are assembled with the pipe 1 as shown in FIG. 17, with the spacing intervals 12 provided between the molds themselves, and between the molds and the pipe as shown in FIG. 14. Thereafter, molten metal is cast or filled into the fin block mold and then the mold material is removed in the same manner as described with reference to the heat exchanger shown in FIG. 1 to produce the heat exchanger shown in FIG. 2 which comprises the heat-transmitting pipe 1, the fin block 2 enclosing straight portions and bends of the pipe 1, and the fin plates 3 located in the fin block 2 substantially horizontally in positions corresponding to the straight portions of the pipe 1 to secure the fin block 2 to the pipe 1, the fin block 2 and the fin plates 3 being secured unitarily to the pipe 1.

Figure 3:
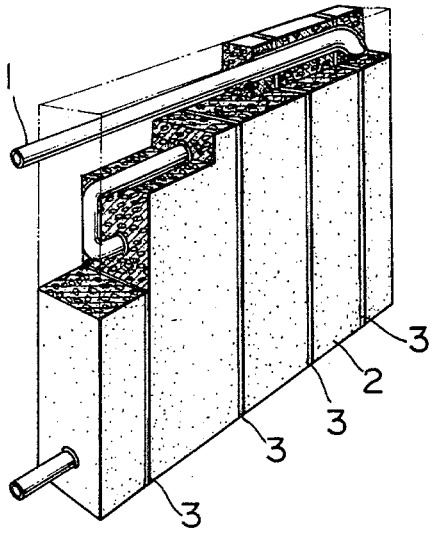
Figure 18:
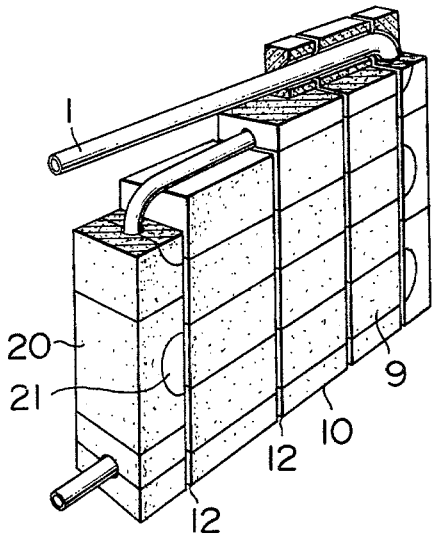

In the heat exchanger shown in FIG. 3, the fin plates 3 are arranged vertically in columns perpendicularly with respect to the length of the heat-transmitting pipe 1. In producing this type of heat exchanger, the fin molds 9 and 10 shown in FIGS. 11 and 12, respectively, are each divided longitudinally into a plurality of mold members which are assembled with the heat-transmitting pipe 1 in such a manner that the spacing intervals 12 in the fin block mold are formed perpendicularly with respect to the length of the heat-transmitting pipe 1 as shown in FIG. 18. Thereafter, process steps similar to those described with reference to the heat exchanger shown in FIG. 1 are followed.

Figure 4:
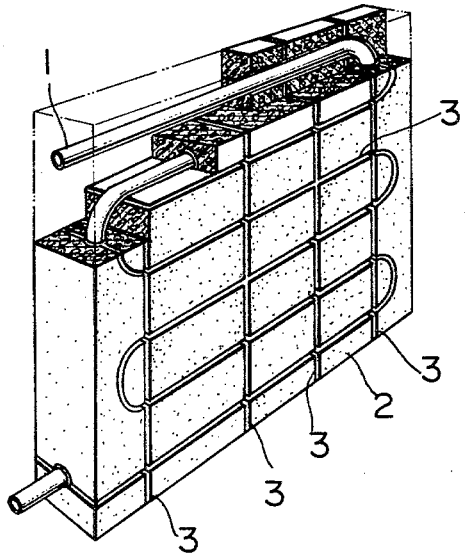
Figure 19:
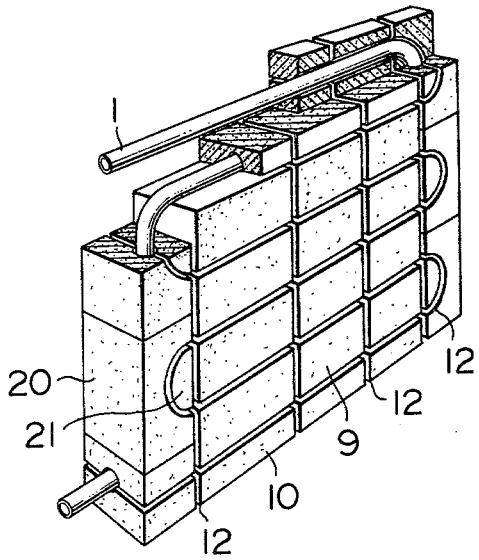

In the heat exchanger shown in FIG. 4, the fin plates 3 are arranged both parallel to the heat-transmitting pipe 1 and perpendicularly with respect to the length of the pipe 1. In producing this type of heat exchanger, the fin molds 9 and 10 shown in FIGS. 11 and 12, respectively, are each divided longitudinally into a plurality of mold members which are assembled with the heat-transmitting pipe 1 in such a manner that the spacing intervals 12 in the fin block mold are formed both parallel to the heat-transmitting pipe 1 and perpendicularly with respect to the length of the pipe 1 as shown in FIG. 19. Thereafter, process steps similar to those described with reference to the heat exchanger shown in FIG. 1 are followed.

Figure 5:
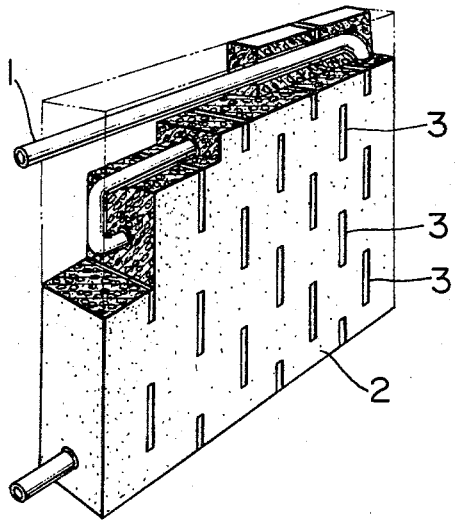
Figure 6:
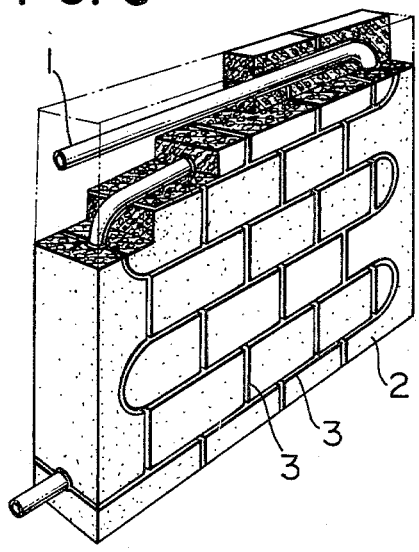
Figure 20:
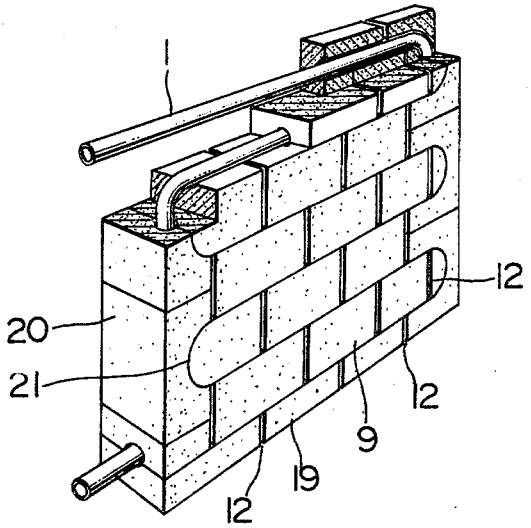
Figure 21:
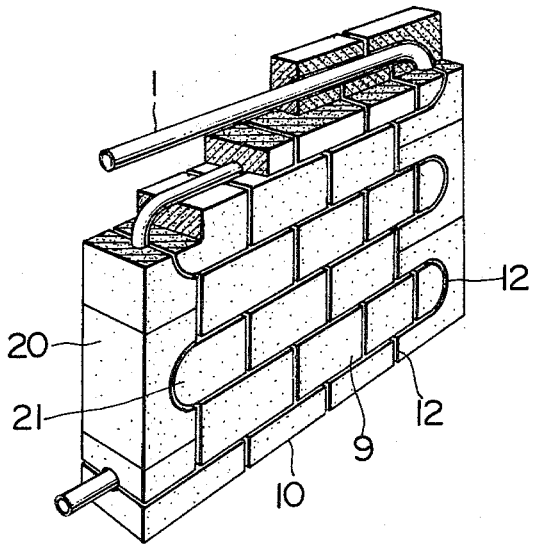

In the heat exchanger shown in FIG. 5, the fin plates 3 are arranged intermittently in vertical discontinuous columns perpendicularly with respect to the length of the heat-transmitting pipe 1, and the fin plates 3 in the adjacent columns are disposed in staggered relationship. In the heat exchanger shown in FIG. 6, the fin plates 3 are arranged both parallel to the heat-transmitting pipe 1 and perpendicularly with respect to the length of the pipe 1. The fin plates 3 are arranged intermittently in vertical discontinuous columns in such a manner that the fin plates 3 in the adjacent columns are disposed in a staggered relationship. The heat exchangers shown in FIGS. 5 and 6 are produced in such a manner that the spacing intervals 12 in the fin block mold are formed in positions where the fin plates 3 are located as shown in FIGS. 20 and 21 respectively, by following a process step similar to that described with reference to the heat exchanger shown in FIG. 1.

In the method of producing heat exchangers described hereinabove, the molten metal filled in the spacing intervals 12 between the fin molds 9 and 10 and the outer and inner fin molds 20 and 21 themselves, and between these molds 9, 10, 20 and 21 and the pipe 1 undergoes contraction when it is cooled and thus solidified. At this time, the molten metal around the heat-transmitting pipe 1 is formed into a tubular shape and applies high contact pressure to the pipe 1 as further contraction thereof takes place, thereby providing a good bond between the pipe 1 and the fin block 2 of porous metal having fins 4 of filament line form or irregular filament line form arranged in a skeleton structure wherein continuous, three-dimensional pores 5 are formed. As a result, the fin block 2 and fin plates 3 are secured unitarily to the heat-transmitting pipe 1 of the serpentine form to provide a heat exchanger of unique construction wherein the fin block 2 and fin plates 3 are adhered to the heat-transmitting pipe 1 with high bond strength.

In the heat exchangers produced by the aforesaid method, the air to be heat-exchanged with the fluid flowing through the heat-transmitting pipe 1 flows quickly, without substantial flow resistance, through the multiplicity of continuous pores 5 defined by the fins 4 of the skeleton structure. As the air flows in this way, exchange of heat takes place with high efficiency between the air and the fluid flowing through the heat-transmitting pipe 1, through the fins 4 of the fin block 2 and the fin plates 3 secured to the heat-transmitting pipe 1 and the fins 4.

The fins 4 of the heat exchangers produced by the method according to the present invention are of mesh-like, three-dimensional arrangement which defines the continuous, three-dimensional pores 5. This feature offers the advantages that the heat-transfer area is increased as compared with the plate-like fins of the prior art, and that the fluid flowing through the continuous pores 5 formed by the fins 4 is agitated at all times because its path is tortuous due to the mesh-like arrangement of the fins 4, thereby inhibiting the development of a thermal boundary layer. Thus the heat exchangers have a high heat-transfer performance and allow heat exchange to take place with high efficiency.

In the ordinary heat exchangers, the heat-transfer rate with respect to air can be expressed by the following formula:

$$h \propto d^{-n} \text{ (generally, } n>0)$$

where h is heat-transfer rate and d is mean diameter. This formula which is well known indicates that the smaller the value of d, the higher is the heat-transfer rate.

In the heat exchangers produced by the method according to the present invention, the fins can be in the form of very slender filaments, thereby further improving the heat-transfer performance of the heat exchangers.

Generally, when a heat exchanger is provided with very slender fins so as to improve heat-transfer rate with respect to air, it is necessary that a large amount of heat be transmitted from the fins remote from the heat-transmitting pipe to the heat-transmitting pipe and from the heat-transmitting pipe to the fins remote from the heat-transmitting pipe, through the slender fins. However, the slender filamentous fins make it impossible to transmit therethrough a large amount of heat. To eliminate this defect, the present invention provides the fin plates 3 incorporated in the fin block 2 to enable the transfer of heat between the heat-transmitting pipe 1 and the fins 4 remote from the heat-transmitting pipe 1 to take place with increased efficiency.

In the heat exchangers shown in FIGS. 5 and 6, the fin plates 3 are arranged in vertical discontinuous columns in such a manner that the fin plates 3 in the adjacent columns are in a staggered relationship. This arrangement of the fin plates 3 makes it possible to equalize the amounts of heat transmitted to the fins 4 from various portions of the heat-transmitting pipe 1 to obtain uniform transfer of heat through the entire length of the pipe 1 by avoiding irregularities in the transfer of heat in various portions of the pipe 1, thereby improving the heat-transfer performance of the heat exchangers.

From the foregoing description, it will be appreciated that the heat exchangers produced by the method according to the present invention offer advantages, which the cross-fin type heat exchangers of the prior art are unable to offer. More specifically, the former heat exchangers have a larger heat-transfer area per unit volume and a higher heat-transfer capacity than the latter. Thus, the invention enables a compact overall size to be obtained in a heat exchanger. Also, since the porous metal is light in weight, the overall weight of the heat exchanger can be reduced. In the production process, a heat-transmitting pipe is shaped into a serpentine or other suitable form beforehand, and fin molds are utilized to produce a fin block by casting which surrounds the heat-transmitting pipe. This eliminates the need to perform the process steps of inserting U-shaped pipes and expanding the pipes. The assembling of the fin molds with the heat-transmitting pipe can be readily performed, and the production process is greatly simplified. Further, contraction of molten metal caused when the molten metal is cooled and solidified greatly increases the bond strength with which the fin block adheres to the heat-transmitting pipe, so that heat transfer between the fins of the fin block and the heat-transfer pipe is facilitated.

What is claimed is:

1. A method for the production of a heat exchanger comprising the steps of:

casting a mold forming material in a fluid state into continuous, three-dimensional cavities in plastic patterns to produce patten-retaining molds;

removing by heating said plastic patterns from said pattern-retaining molds to produce fin molds;

assembling a plurality of said fin molds with a heat-transmitting pipe shaped beforehand into a substantially serpentine form in such a manner that said fin molds enclose said heat-transmitting pipe with suitable spacing intervals defined between said fin molds themselves and between said fin molds and said heat-transmitting pipe, thereby to produce a fin block mold formed therein with continuous, three-dimensional cavities;

casting by introducing molten metal under pressure into said continuous, three-dimensional cavities in said fin block mold and into said spacing intervals and allowing said molten metal to solidify; and removing the material of said fin block mold, thereby producing said heat exchanger in which a porous metal block formed with continuous, three-dimensional pores and fin plates connected to said porous metal block which are unitarily secured to said heat-transmitting pipe.

2. A method for the production of a heat exchanger comprising the steps of:

casting a mold forming material in a fluid state into continuous, three-dimensional cavities in plastic patterns to produce pattern-retaining molds;

assembling a plurality of said pattern-retaining molds with a heat-transmitting pipe shaped beforehand into a substantially serpentine form in such a manner that said pattern-retaining molds enclose said heat-transmitting pipe with suitable spacing intervals defined between said pattern-retaining molds themselves and between said pattern-retaining molds and said heat-transmitting pipe;

removing by heating said plastic patterns from said pattern-retaining molds to produce a fin block mold formed therein with continuous, three-dimensional cavities;

casting by introducing molten metal under pressure into said continuous, three-dimensional cavities in said fin block mold and into said spacing intervals and allowing said molten metal to solidify; and removing the material of said fin block mold, thereby producing said heat exchanger in which a porous metal block formed with continuous, three-dimensional pores and fin plates connected to said porous metal block which are unitarily secured to said heat-transmitting pipe.

* * * * *